US009255437B2

(12) United States Patent
Kershner et al.

(10) Patent No.: US 9,255,437 B2
(45) Date of Patent: Feb. 9, 2016

(54) OVEN APPLIANCE WITH DUAL OPENING DOORS

(71) Applicant: General Electric Company, Schenectady, NY (US)

(72) Inventors: Scott Thomas Kershner, La Grange, KY (US); John Adam Yantis, Prospect, KY (US); John Mark Chilton, Campbellsburg, KY (US); Srisurya Prakash Pilli, Hyderabad (IN)

(73) Assignee: General Electric Company, Schenectady, NY (US)

( * ) Notice: Subject to any disclaimer, the term of this patent is extended or adjusted under 35 U.S.C. 154(b) by 412 days.

(21) Appl. No.: 13/848,186

(22) Filed: Mar. 21, 2013

(65) Prior Publication Data

US 2014/0283811 A1 Sep. 25, 2014

(51) Int. Cl.
*E05F 17/00* (2006.01)
*F24C 15/02* (2006.01)

(52) U.S. Cl.
CPC ..... *E05F 17/004* (2013.01); *F24C 15/023* (2013.01); *E05Y 2201/656* (2013.01); *E05Y 2201/686* (2013.01); *E05Y 2800/205* (2013.01); *E05Y 2800/22* (2013.01); *E05Y 2800/244* (2013.01); *E05Y 2900/308* (2013.01)

(58) Field of Classification Search
CPC .... E05F 17/004; F24C 15/023; F24C 15/028; F24C 15/022; E05Y 2201/656; E05Y 2201/686; E05Y 2800/205; E05Y 2800/22; E05Y 2800/244; E05Y 2900/308
See application file for complete search history.

(56) References Cited

U.S. PATENT DOCUMENTS 2,034,781 A 3/1936 Strandt
3,707,145 A * 12/1972 Anetsberger et al. ..... 126/21 A

* cited by examiner

*Primary Examiner* — Alfred Basichas
(74) *Attorney, Agent, or Firm* — Dority & Manning, P.A.

(57) ABSTRACT

The present subject matter provides an oven appliance. The oven appliance includes a pair of doors. A pair of sprockets or gears, a pair of chains, and a pair of connecting members couple the doors to each other such that the doors open and close simultaneously. The oven appliance also includes features for limiting or eliminating contact between the connecting members at a location where the connecting members cross each other.

17 Claims, 7 Drawing Sheets

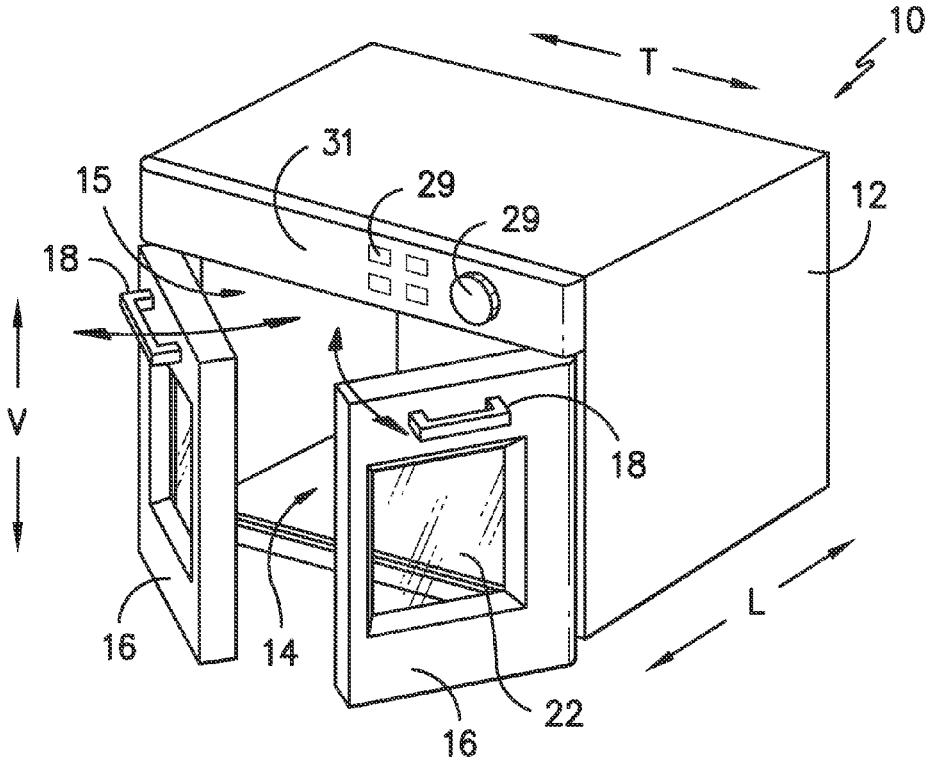
FIG. —1—
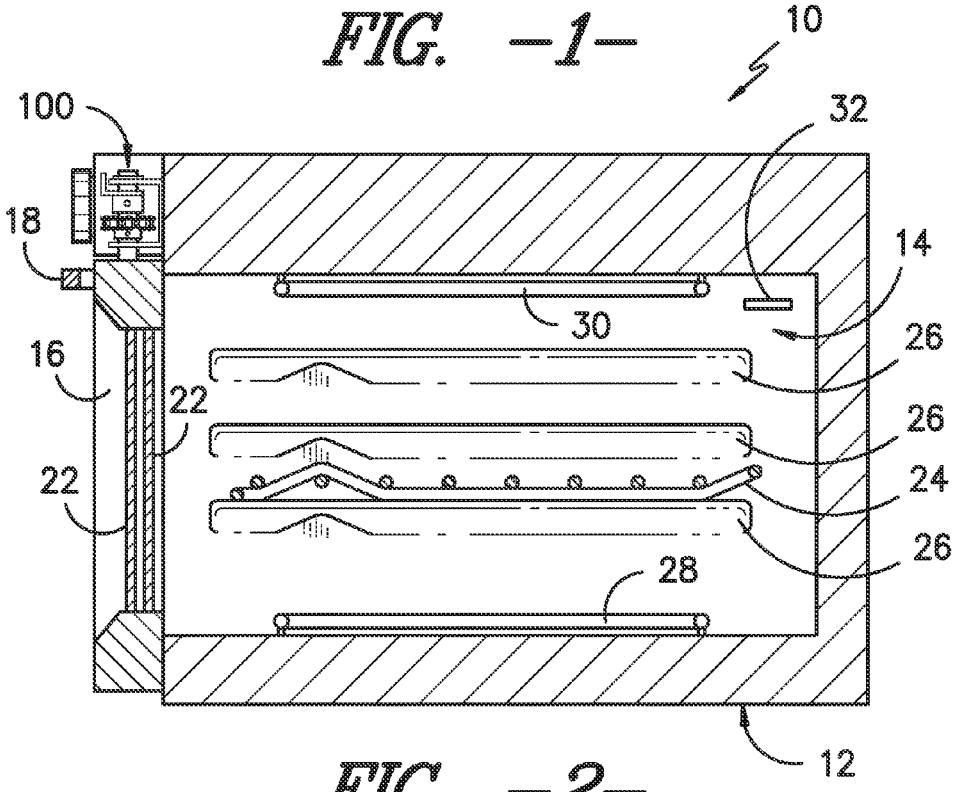
FIG. —2—

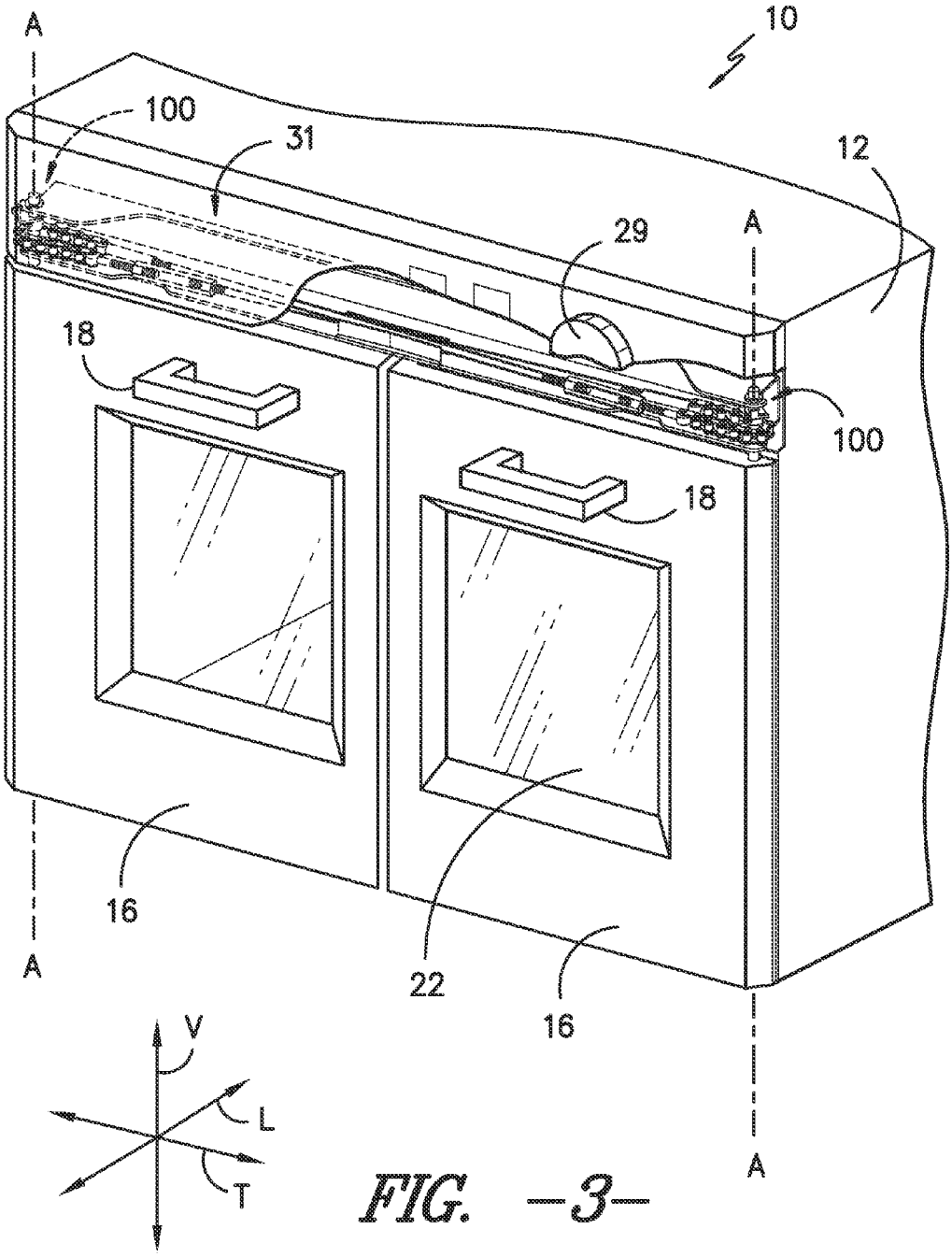
FIG. —3—

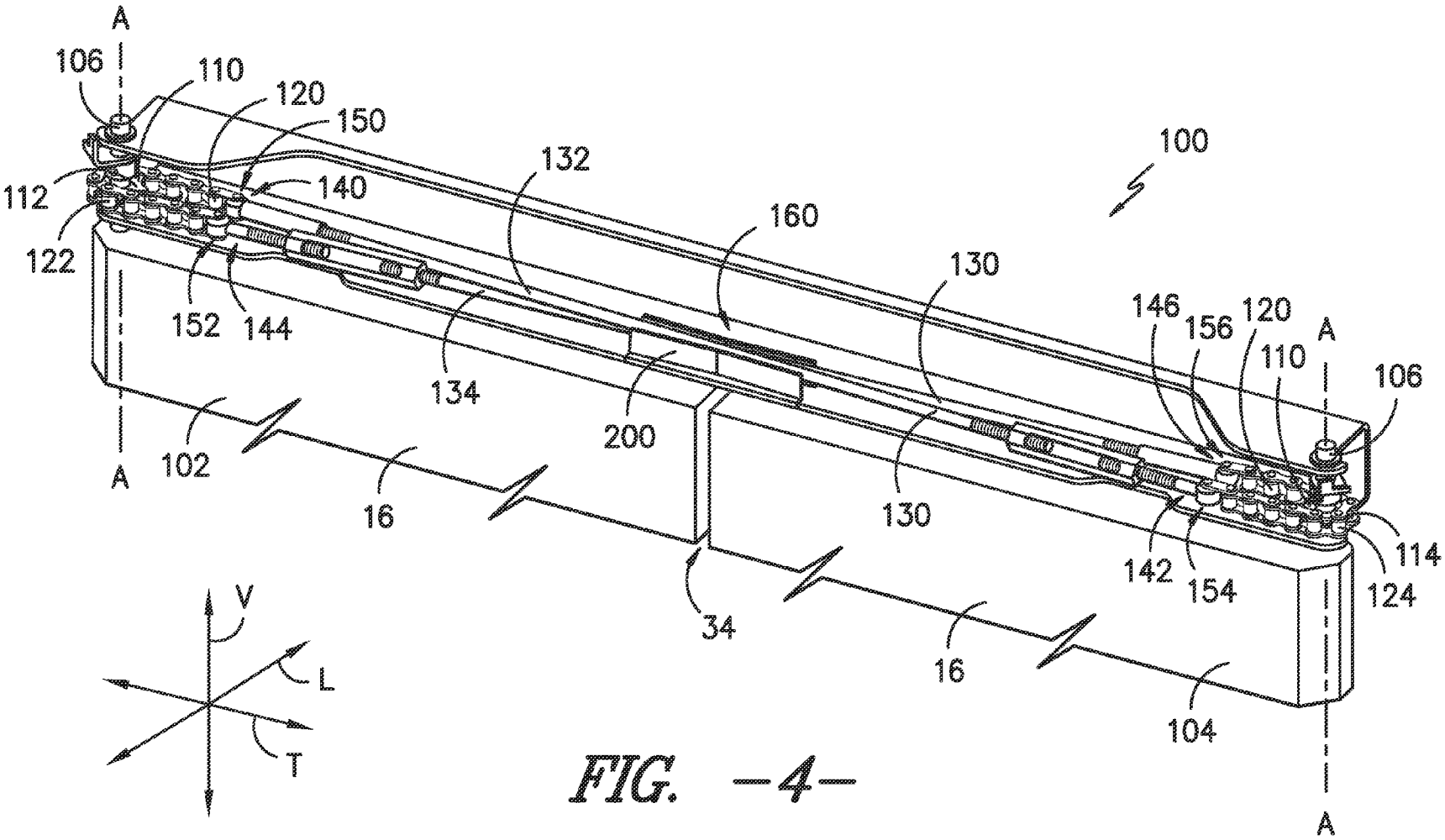
FIG. —4—

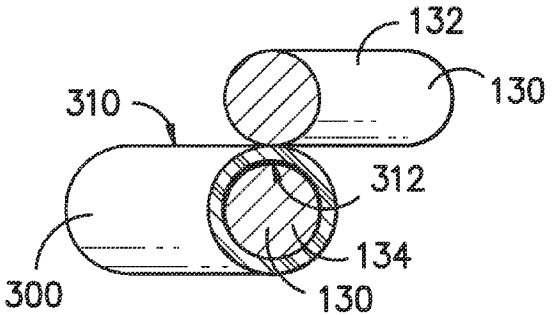
FIG. —7—
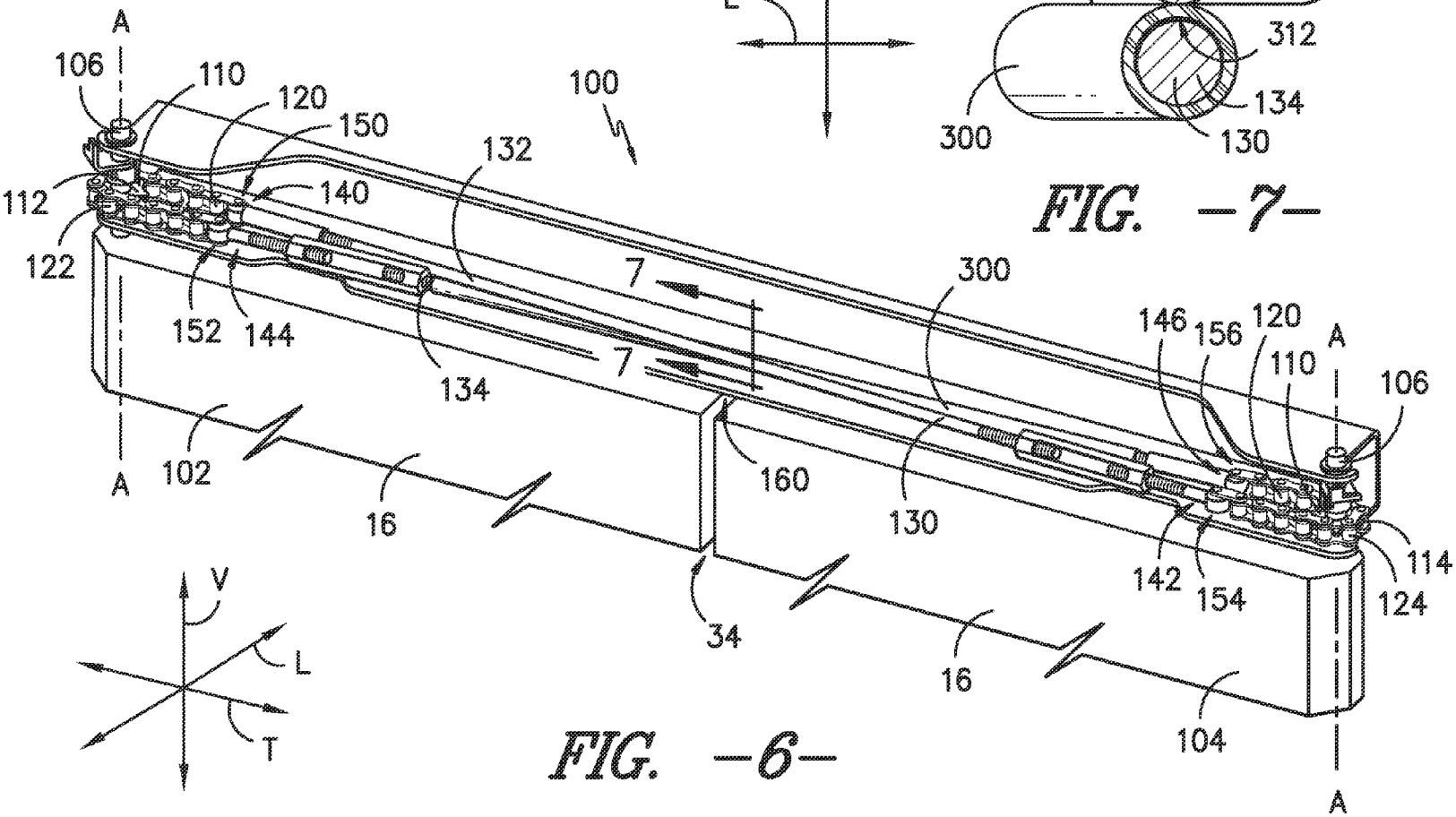
FIG. —6—

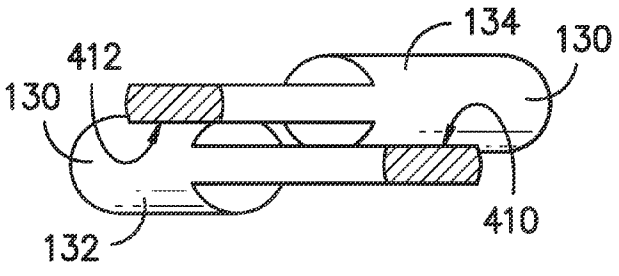
FIG. —9—
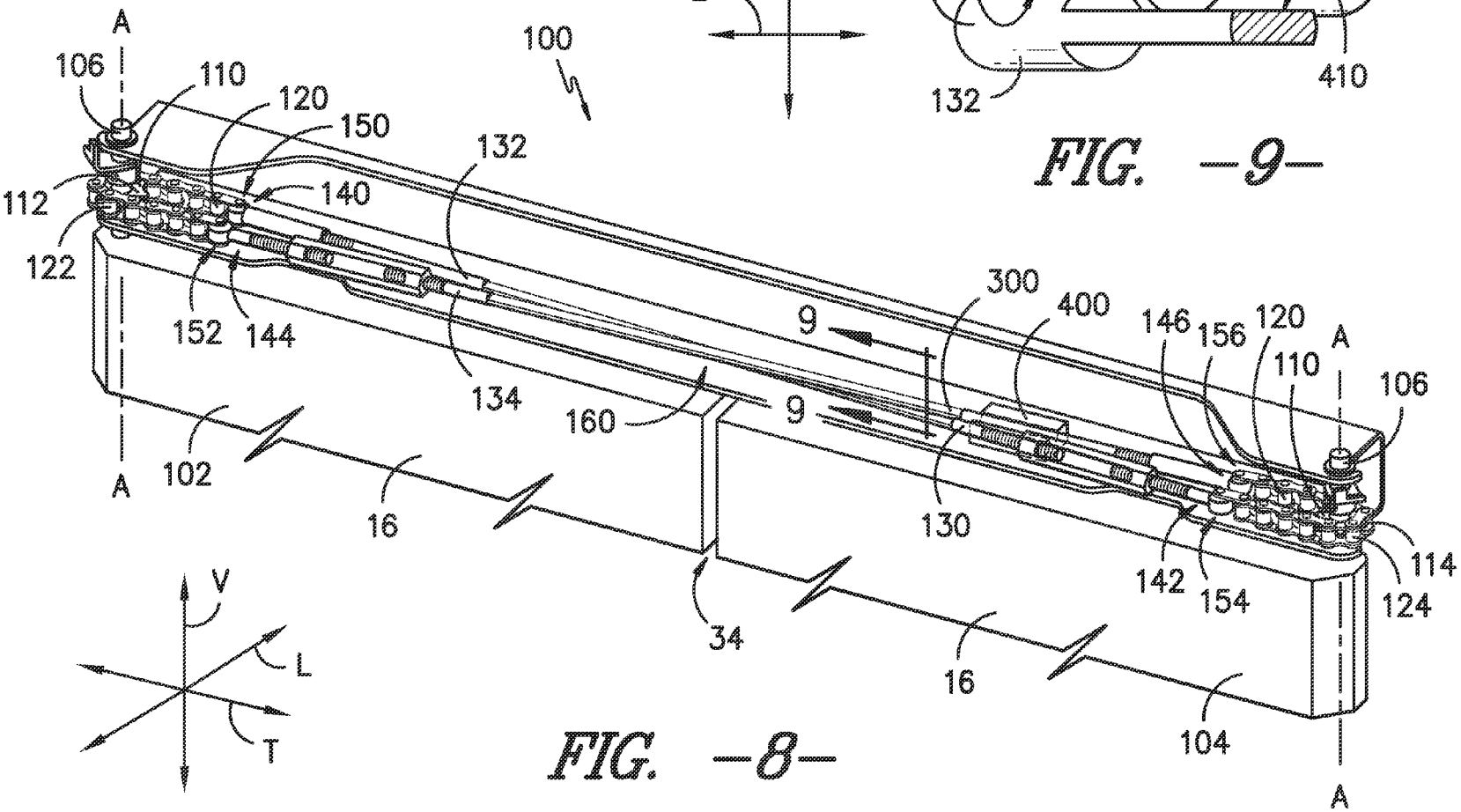
FIG. —8—

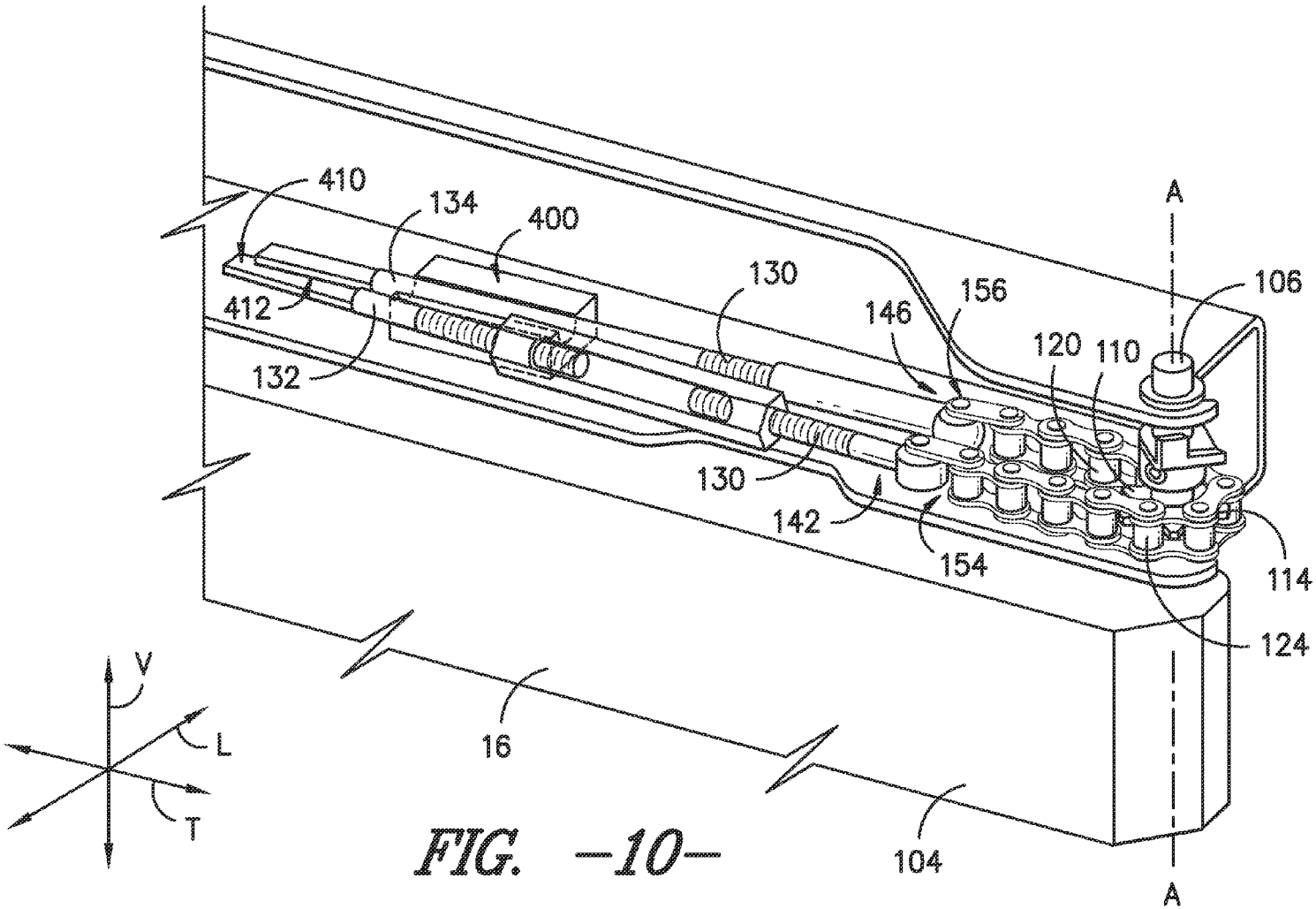
FIG. —10—

OVEN APPLIANCE WITH DUAL OPENING DOORS

FIELD OF THE INVENTION

The present subject matter relates generally to oven appliances, such as French door oven appliances.

BACKGROUND OF THE INVENTION

Oven appliances generally include a cabinet that defines a cooking chamber for receipt of food articles for cooking. The cabinet can also define an opening for accessing the cooking chamber. Certain oven appliances include a pair of doors rotatably mounted to the cabinet at the opening to permit selective access to the cooking chamber through the opening. Oven appliances having such doors are generally referred to as French door style oven appliances.

Certain French door oven appliances include a linkage assembly that connects the oven appliance's pair of doors such that the doors open and close simultaneously. Such a configuration can be useful. For example, the pair of doors can each include a handle. By providing a linkage assembly that connects the pair of doors, a user can pull on either handle in order to open or close both of the doors simultaneously. Thus, a user holding food items in one hand can open or close both doors with the other free hand.

Certain linkage assemblies include rods or other connecting members that cross each other. During opening and closing of the doors, such rods or other connecting members can rub against each other. Over time, significant wear damage can develop due to such contact. Further, such contact can be noisy and/or generate debris that negatively affects performance of the oven appliance.

Accordingly, an oven appliance with features for improving performance of a linkage assembly that couples a pair of doors of the oven appliance would be useful. In particular, an oven appliance with features for limiting or eliminating contact between connecting members of the linkage assembly would be useful.

BRIEF DESCRIPTION OF THE INVENTION

The present subject matter provides an oven appliance. The oven appliance includes a pair of doors. A pair of sprockets or gears, a pair of chains, and a pair of connecting members couple the doors to each other such that the doors open and close simultaneously. The oven appliance also includes features for limiting or eliminating contact between the connecting members at a location where the connecting members cross each other. Additional aspects and advantages of the invention will be set forth in part in the following description, or may be apparent from the description, or may be learned through practice of the invention.

In a first exemplary embodiment, an oven appliance is provided. The oven appliance includes a cabinet that defines a chamber for receipt of food items for cooking. The chamber is accessible through an opening defined by the cabinet. A heating element provides heat to food items within the chamber of the cabinet. A pair of doors is mounted proximate the opening. Each door of the pair of doors has an axis of rotation about which the door is rotatable so as to open or close access to the chamber of the cabinet through the opening of the cabinet. The oven appliance also includes a pair of sprockets, a pair of chains, and a pair of connecting members. Each sprocket of the pair of sprockets is connected with a respective door of the pair of doors and is positioned along the axis of rotation of the door so as to rotate with the door. Each chain of the pair of chains meshes with a respective sprocket of the pair of sprockets. The connecting members extend between and connect the chains of the pair of chains such that rotational motion is transferred between the pair of doors. The oven appliance also includes means for limiting or eliminating contact between the connecting members at a location where the connecting members cross each other.

In a second exemplary embodiment, an oven appliance is provided. The oven appliance includes a cabinet that defines a chamber for receipt of food items for cooking. The chamber is accessible through an opening defined by the cabinet. A heating element provides heat to food items within the chamber of the cabinet. A pair of doors is mounted proximate the opening. Each door of the pair of doors has an axis of rotation about which the door is rotatable so as to open or close access to the chamber of the cabinet through the opening of the cabinet. The oven appliance also includes a pair of sprockets, a pair of chains, and a pair of connecting members. Each sprocket of the pair of sprockets is connected with a respective door of the pair of doors and is positioned along the axis of rotation of the door so as to rotate with the door. Each chain of the pair of chains meshes with a respective sprocket of the pair of sprockets. The connecting members extend between and connect the chains of the pair of chains such that rotational motion is transferred between the pair of doors. A cross-block is positioned between the connecting members at a location where the connecting members cross each other.

In a third exemplary embodiment, an oven appliance is provided. The oven appliance includes a cabinet that defines a chamber for receipt of food items for cooking. The chamber is accessible through an opening defined by the cabinet. A heating element provides heat to food items within the chamber of the cabinet. A pair of doors is mounted proximate the opening. Each door of the pair of doors has an axis of rotation about which the door is rotatable so as to open or close access to the chamber of the cabinet through the opening of the cabinet. The oven appliance also includes a pair of sprockets, a pair of chains, and a pair of connecting members. Each sprocket of the pair of sprockets is connected with a respective door of the pair of doors and is positioned along the axis of rotation of the door so as to rotate with the door. Each chain of the pair of chains meshes with a respective sprocket of the pair of sprockets. The connecting members extend between and connect the chains of the pair of chains such that rotational motion is transferred between the pair of doors. A sleeve is positioned on one of the connecting members such that the sleeve is positioned between the connecting members at a location where the connecting members cross each other.

In a fourth exemplary embodiment, an oven appliance is provided. The oven appliance includes a cabinet that defines a chamber for receipt of food items for cooking. The chamber is accessible through an opening defined by the cabinet. A heating element provides heat to food items within the chamber of the cabinet. A pair of doors is mounted proximate the opening. Each door of the pair of doors has an axis of rotation about which the door is rotatable so as to open or close access to the chamber of the cabinet through the opening of the cabinet. The oven appliance also includes a pair of sprockets, a pair of chains, and a pair of connecting members. Each sprocket of the pair of sprockets is connected with a respective door of the pair of doors and is positioned along the axis of rotation of the door so as to rotate with the door. Each chain of the pair of chains meshes with a respective sprocket of the pair of sprockets. The connecting members extend between and connect the chains of the pair of chains such that rotational motion is transferred between the pair of doors. A spacer block is mounted to the cabinet and engages a first one of the connecting members in order to position the first one of the connecting members such that the first one of the connecting members is spaced apart from a second one of the connecting members at a location where the connecting members cross each other.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a perspective view of an oven appliance according to an exemplary embodiment of the present subject matter.

FIG. 2 provides a side, section view of the exemplary oven appliance of FIG. 1.

FIG. 3 provides a partial, front perspective view of the exemplary oven appliance of FIG. 1 and shows an exemplary linkage assembly that couples doors of the oven appliance together.

FIG. 4 provides a perspective view of the exemplary linkage assembly of FIG. 3.

FIG. 6 provides a perspective view of a linkage assembly according to an additional exemplary embodiment of the present subject matter.

FIG. 7 provides a section view of certain components the exemplary linkage assembly of FIG. 6 taken along the 7-7 line of FIG. 6.

FIG. 8 provides a perspective view of a linkage assembly according to another exemplary embodiment of the present subject matter.

FIG. 9 provides a section view of certain components the exemplary linkage assembly of FIG. 8 taken along the 9-9 line of FIG. 8.

FIG. 10 provides a partial, perspective view of the exemplary linkage assembly of FIG. 8.

DETAILED DESCRIPTION

Figure 5:
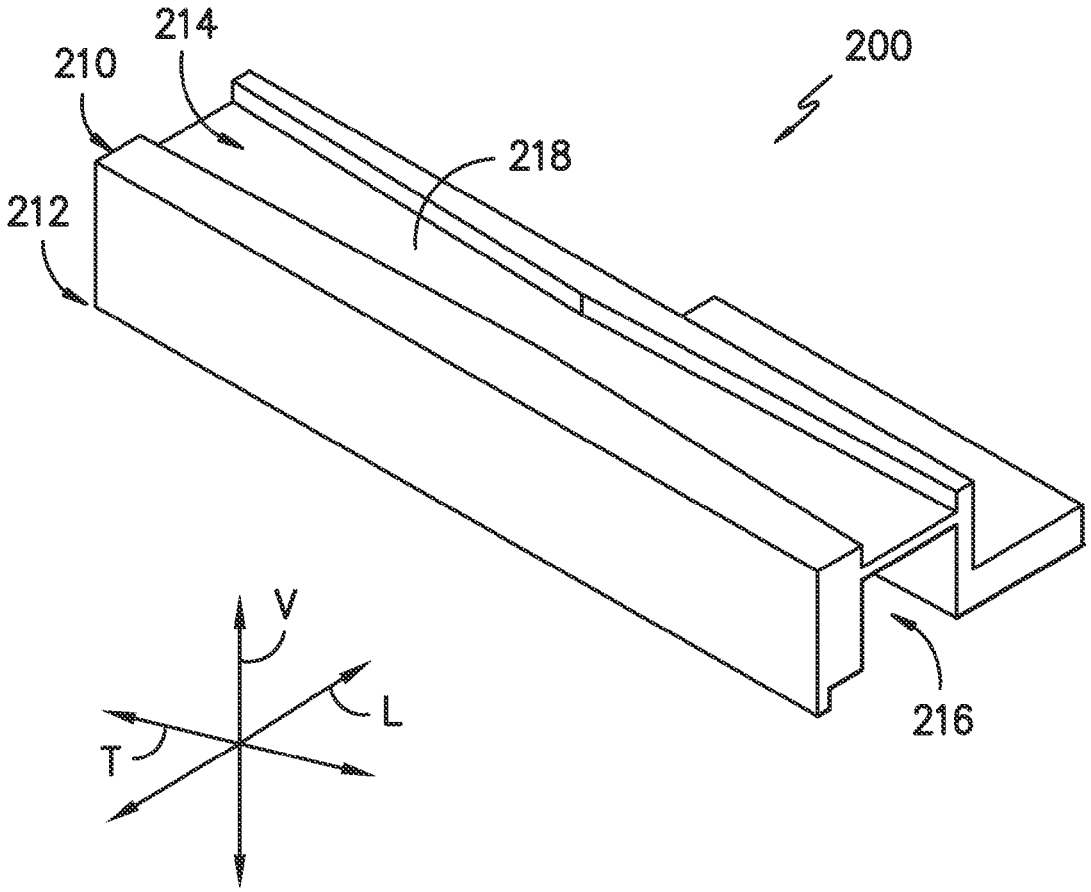
FIG. 5 provides a perspective view of a cross-block of the exemplary linkage assembly of FIG. 3.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 illustrate an oven appliance 10 according to an exemplary embodiment of the present subject matter. Oven appliance 10 defines a vertical direction V, a lateral direction L, and a transverse direction T. The vertical, lateral, and transverse direction V, L, and T are mutually perpendicular and form an orthogonal direction system.

Oven appliance 10 includes an insulated cabinet 12 that defines an interior cooking chamber 14 and is configured for the receipt of one or more food items to be cooked. Oven appliance 10 includes a pair of doors 16, sometimes referred to as "French doors," that are, e.g., rotatably, mounted on cabinet 12 proximate an opening 15 to chamber 14. Handles 18 allows for pulling one or both of doors 16 to access to chamber 14 as will be further described below.

One or more seals (not shown) between doors 16 and cabinet 12 provide for maintaining heat and cooking fumes within chamber 14 when doors 16 are closed. Glass panes 22 provide for viewing the contents of chamber 14 when doors 16 are closed as well as providing insulation between chamber 14 and the exterior of oven appliance 10. A rack 24 is positioned in chamber 14 for the receipt of food items. Rack 24 is slidably received onto ribs/rails 26 such that rack 24 may be conveniently moved into and out of chamber 14 when doors 16 are open. Multiple rails 26 are provided so that the height of rack may be adjusted.

Heating elements 28 and 30 are positioned within the chamber 14 of cabinet 12. Heating elements 28 and 30 are used to heat chamber 14 for both cooking and cleaning of oven appliance 10. While electrically-resistive heating elements 28 and 30 are shown, the present invention may be used with other heating elements as well such as gas burners or microwave elements.

The operation of oven appliance 10 including heating elements 28 and 30 is controlled by one or more processing devices (not shown) such as a microprocessor other device that is in communication with such components. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside chamber 14. Although only one temperature sensor 32 is shown, it should be understood that multiple sensors 32 could be placed into oven appliance 10 for determining the oven temperature.

The arrangement of oven appliance 10 is provided by way of example only and is not intended to limit the present subject matter in any aspect. The present subject matter can be used with other oven configurations as well. For example, the present subject matter may be used with an oven appliance that defines multiple interior cavities for the receipt of food and/or has different pan or rack arrangements than what is shown in FIG. 2. Heating elements at the top, back, or sides of chamber 14 may also be provided. Other configurations may also be used as will be understood by one of skill in the art using the teachings disclosed herein.

FIG. 3 provides a partial, front perspective view of oven appliance 10 and shows an exemplary linkage assembly 100 that couples doors 16 together. Doors 16 are mounted to cabinet 12 such that each door 16 is rotatable about a respective axis of rotation A-A. Axis A-A may extend, e.g., along the vertical direction V. Doors 16 are mounted proximate opening 15 of cabinet 12. Doors 16 are rotatable so as to open or close access to chamber 14 of cabinet 12 through opening 15 of cabinet 12.

Linkage assembly 100 couples doors 16 to each other such that doors 16 rotate open and closed together. For example, if a user pulls on one of handles 18 with doors 16 closed, both doors 16 will open due linkage assembly 100. Therefore, a user can, e.g., use only one hand to open both doors 16 of oven appliance 10 at the same time. Linkage assembly 100 can be positioned at any suitable location within cabinet 12. For example, linkage assembly 100 may be positioned above doors 16 along the vertical direction V and concealed or hidden from view behind or within control panel 31 of cabinet 12. In alternative exemplary embodiments, linkage assembly 100 may be located below doors 16 along the vertical direction V and, e.g., still contained within cabinet 12 as well. Linkage assembly 100 is discussed in greater detail below.

FIG. 4 provides a perspective view of linkage assembly 100. FIG. 5 provides a perspective view of a cross-block 200 of linkage assembly 100. As discussed above, linkage assembly 100 is configured for transferring rotational motion between doors 16, e.g., to permit a user to open both doors 16 with one hand.

As may be seen in FIG. 4, linkage assembly 100 includes a pair of, e.g., circular, gears or sprockets 110. Each sprocket of sprockets 110 is connected with or mounted to a respective door of doors 16. In particular, sprockets 110 include a first sprocket 112 and a second sprocket 114. First sprocket 112 is mounted to a first door 102 of doors 16. Conversely, second sprocket 114 is mounted to a second door 104 of doors 16. Thus, sprockets 110 are spaced apart from each other, e.g., along the transverse direction T.

Sprockets 110 are positioned along the axes of rotation R-R of doors 16. Thus, sprockets 110 rotate with door 16 as doors 16 are rotated about axes of rotation R-R. Sprockets 110 can be mounted to doors 16 in any suitable manner. For example, sprockets 110 may be mounted to posts 106 of doors 16 that extend along the axes of rotation R-R of doors 16.

Linkage assembly 100 also includes a pair of chains 120. Each chain of chains 120 meshes with a respective sprocket of sprockets 110. In particular, a first chain 122 of chains 120 meshes with first sprocket 112, e.g., teeth of first sprocket 112. Conversely, a second chain 124 of chains 120 meshes with second sprocket 114, e.g., teeth of second sprocket 114. Thus, chains 120 are spaced apart from each other, e.g., along the transverse direction T.

A pair of connecting members 130 extends between and connects chains 120 such that rotational motion of either of doors 16 is transferred to the other of doors 16. Thus, connecting members 130 couple chains 120 together such that rotational motion of doors 16 is transferred between doors 16. Connecting members 130 can be any suitable member for coupling chains 120 together. For example, connecting members 130 may be rods, shafts, cables, etc.

Connecting members 130 include a first connecting member 132 and a second member 134. First connecting member 132 extends between a first end portion 140 and a second end portion 142. Thus, first and second end portions 140 and 142 of first connecting member 132 are spaced apart from each other, e.g., along the transverse direction T. Second connecting member 134 also extends between a first end portion 144 and a second end portion 146. First and second end portions 144 and 146 of second connecting member 134 are spaced apart from each other, e.g., along the transverse direction T. First end portion 140 of first connecting member 132 is positioned proximate first end portion 144 of second connecting member 134. Conversely, second end portion 142 of first connecting member 132 is positioned proximate second end portion 146 of second connecting member 134.

As discussed above, connecting members 130 couple chains 120 together. In particular, first end portion 140 of first connecting member 132 is coupled or, e.g., rotatably, mounted to a first end portion 150 of first chain 122, and first end portion 144 of second connecting member 134 is coupled or, e.g., rotatably, mounted to a second end portion 152 of first chain 122. Conversely, second end portion 142 of first connecting member 132 is coupled or, e.g., rotatably, mounted to a first end portion 154 of second chain 124, and second end portion 146 of second connecting member 134 is coupled or, e.g., rotatably, mounted to a second end portion 156 of second chain 124. In such a manner, connecting members 130 can extend between and couple chains 120 together.

Connecting members 130 cross each other as connecting members 130 extend and connect chains 120, e.g., such that connecting members 130 and chains 120 form a figure eight shape geometry. In particular, connecting members 130 can cross each other above a gap 34 between doors 16 as viewed from a plane that is substantially perpendicular to the vertical direction V. As will be understood by those skilled in the art, linkage assembly 100 can rotate doors 16 in opposite rotational directions due to connecting members 130 crossing each other. As may be seen in FIG. 4, connecting members 130 cross each other at a location or position 160, e.g., between sprockets 110 along the transverse direction T. As discussed in greater detail below, linkage assembly 100 also includes features for limiting or eliminating contact between connecting members 130, e.g., at location 160 where connecting members 130 cross each other.

In the exemplary embodiment shown in FIG. 4, linkage assembly 100 includes a cross-block 200 positioned between connecting members 130 at location 160 where connecting members 130 cross each other. Cross-block 200 is mounted to cabinet 12 and, e.g., assists with limiting or eliminating contact between connecting members 130 at location 160 where connecting members 130 cross each other.

As may be seen in FIG. 5, cross-block 200 defines a first channel 214 and a second channel 216. First and second channels 214 and 216 of cross-block 200 are positioned on opposite sides of cross-block 200 relative to each other. In particular, cross-block 200 extends between a first side portion 210 and a second side portion 212, e.g., along the vertical direction V. Thus, first and second side portions 210 and 212 of cross-block 200 are spaced apart from each other, e.g., along the vertical direction V. First channel 214 is defined at or proximate first side portion 210 of cross-block 200. Conversely, second channel 216 is defined at or proximate second side portion 212 of cross-block 200.

First connecting member 132 is positioned or disposed within first channel 214 of cross-block 200. Conversely, second connecting member 134 is positioned or disposed within second channel 216 of cross-block 200. Thus, cross-block 200 is positioned between first and second connecting member 132 and 134, e.g., at location 160 where connecting members 130 cross each other. In particular, a plate 218 of cross-block 200 is positioned between first and second connecting member 132 and 134, e.g., at location 160 where connecting members 130 cross each other. Thus, first and second connecting members 132 and 134 can slide on plate 218 of cross-block 200 during opening and closing of doors 16, e.g., such that cross-block 200 limits or eliminates contact between connecting members 130 at location 160 where connecting members 130 cross each other.

Cross-block 200 can be constructed with any suitable material. For example, cross-block 200 may be milled or molded from a plastic or polymer, such as polyethylene, nylon, or polytetrafluoroethylene. Connecting members 130 can also be constructed with any suitable material. For example, connecting members 130 may be constructed with a metal, such as steel. In the exemplary embodiment shown in FIG. 4, cross-block 200 is constructed with plastic and connecting members 130 are constructed with metal. Thus, cross-block 200 is relatively soft compared to connecting members 130. By positioning cross-block 200 between connecting members 130 at location 160 where connecting members 130 cross each other, cross-block 200 can assist with hindering metal debris formation caused by rubbing or other wear between connecting members 130 at location 160. Further, cross-block 200 can assist with reducing friction within linkage assembly 100. Thus, doors 16 can open and close more smoothly. In addition, providing linkage assembly 100 with cross-block 200 can eliminate noise generated by metal on metal contact at location 160 where connecting members 130 cross each other.

FIG. 6 provides a perspective view of linkage assembly 100 according to an additional exemplary embodiment of the present subject matter. FIG. 7 provides a section view of certain components linkage assembly 100 taken along the 7-7 line of FIG. 6. In the exemplary embodiment shown in FIGS. 6 and 7, linkage assembly 100 includes features for limiting or eliminating contact between connecting members 130, e.g., at location 160 where connecting members 130 cross each other. In particular, linkage assembly 100 includes a sleeve 300. Sleeve 300 is positioned on second connecting member 134, e.g., such that sleeve 300 is positioned between first connecting member 132 and second connecting member 134 at location 160 where connecting members 130 cross each other.

As may be seen in FIG. 7, sleeve 300 includes an outer surface 310 and an inner surface 312. Inner surface 312 of sleeve 300 is positioned on or adjacent second connecting member 134. Conversely, outer surface 310 of sleeve 300 contacts first connecting member 132, e.g., at location 160 where connecting members 130 cross each other. Thus, outer surface 310 of sleeve 300 is positioned at or adjacent first connecting member 132, e.g., at location 160 where connecting members 130 cross each other.

Second connecting member 134 is substantially disposed within sleeve 300. Thus, sleeve 300 can extend between about first and second end portions 144 and 146 of second connecting member 134. Sleeve 300 can be constructed with any suitable material. For example, sleeve 300 may constructed with from a plastic or polymer, such as polyethylene or nylon.

Sleeve 300 can function in a similar manner to cross-block 200 (FIG. 5). For example, by positioning sleeve 300 between connecting members 130 at location 160 where connecting members 130 cross each other, sleeve 300 assists with limiting or eliminating contact between connecting members 130 at location 160 where connecting members 130 cross each other. In particular, first connecting member 132 can slide on outer surface 310 of sleeve 300 during opening and closing of doors 16, e.g., such that sleeve 300 limits or eliminates contact between connecting members 130 at location 160 where connecting members 130 cross each other.

Sleeve 300 can assist with hindering metal debris formation caused by rubbing or other wear between connecting members 130 at location 160. Further, sleeve 300 can assist with reducing friction within linkage assembly 100. Thus, doors 16 can open and close more smoothly. In addition, providing linkage assembly 100 with sleeve 300 can eliminate noise generated by metal on metal contact at location 160 where connecting members 130 cross each other.

FIG. 8 provides a perspective view of linkage assembly 100 according to another exemplary embodiment of the present subject matter. FIG. 9 provides a section view of certain components linkage assembly 100 taken along the 9-9 line of FIG. 8. FIG. 10 provides a partial, perspective view of linkage assembly 100. In the exemplary embodiment shown in FIGS. 8, 9, and 10, linkage assembly 100 also includes features for limiting or eliminating contact between connecting members 130, e.g., at location 160 where connecting members 130 cross each other.

In particular, linkage assembly 100 includes a spacer block 400. Spacer block 400 is mounted to cabinet 12 and engages second connecting member 134. By engaging second connecting member 134, spacer block 400 can urge second connecting member 134 away from first connecting member 132 at location 160 where connecting members 130 cross each other. Thus, spacer block 400 can position second connecting member 134 such that second connecting member 134 is spaced apart from first connecting member 132, e.g., along the vertical direction V, at location 160 where connecting members 130 cross each other. Spacer block 400 can be positioned at any suitable location. For example, spacer block 400 may be positioned proximate or at one of sprockets 110, e.g., second sprocket 114 as shown in FIG. 10. Spacer block 400 can be constructed with any suitable material. For example, spacer block 400 may constructed with from a plastic or polymer, such as polyethylene or nylon.

Like cross-block 200 (FIG. 5) and/or sleeve 300, spacer block 400 can assist with limiting or eliminating contact between connecting members 130 at location 160 where connecting members 130 cross each other. For example, spacer block 400 can urge first and second connecting members 132 and 134 apart at location 160 where connecting members 130 cross each other. Thus, second connecting member 134 can slide past first connecting member 132 without contacting first connecting member 132 during opening and closing of doors 16 due to spacer block 400.

Spacer block 400 can assist with hindering metal debris formation caused by rubbing or other wear between connecting members 130 at location 160. Further, spacer block 400 can assist with reducing friction within linkage assembly 100. Thus, doors 16 can open and close more smoothly. In addition, providing linkage assembly 100 with spacer block 400 can eliminate noise generated by metal on metal contact at location 160 where connecting members 130 cross each other.

As may be seen in FIG. 9, each connecting member of connecting members 130 defines a substantially flat face. In particular, first connecting member 132 defines a face 410, and second connecting member 134 defines a face 412. Face 410 of first connecting member 132 extends between about first and second end portions 140 and 142 of first connecting member 132. Similarly, face 412 of second connecting member 134 extends between about first and second end portions 144 and 146 of second connecting member 134. Face 410 of first connecting member 132 faces or is positioned opposite face 412 of second connecting member 134, e.g., at location 160 where connecting members 130 cross each other. Thus, face 410 of first connecting member 132 can be positioned adjacent or proximate face 412 of second connecting member 134 at location 160 where connecting members 130 cross each other, e.g., such that face 410 of first connecting member 132 is substantially parallel to face 412 of second connecting member 134 in a plane that is perpendicular to the vertical direction V. Face 410 of first connecting member 132 is spaced apart from face 412 of second connecting member 134, e.g., along the vertical direction V.

In various exemplary embodiments, first connecting member 132 is constructed with a first material and second connecting member 134 is constructed with a second material. The first and second materials can be different. For example, the first material may have a hardness that is less than a hardness of the second material. In such a manner, metal debris generation caused by rubbing or other wear between connecting members 130 at location 160 can be hindered or limited.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet defining a chamber for receipt of food items for cooking, the chamber being accessible through an opening defined by the cabinet;

a heating element for providing heat to food items within the chamber of the cabinet;

a pair of doors mounted proximate the opening, each door of the pair of doors having an axis of rotation about which the door is rotatable so as to open or close access to the chamber of the cabinet through the opening of the cabinet;

a pair of sprockets, each sprocket of the pair of sprockets connected with a respective door of the pair of doors and positioned along the axis of rotation of the door so as to rotate with the door;

a pair of chains, each chain of the pair of chains meshing with a respective sprocket of the pair of sprockets;

a pair of connecting members extending between and connecting the chains of the pair of chains such that rotational motion is transferred between the pair of doors; and a cross-block positioned between the connecting members at a location where the connecting members cross each other, the cross-block defining a first channel and a second channel, the first and second channels of the cross-block positioned on opposite sides of the cross-block relative to each other, a first one of the connecting members positioned within the first channel of the cross-block and a second one of the connecting members positioned within the second channel of the cross-block such that the cross-block is positioned between the first and second ones of the connecting members.

2. The oven appliance of claim 1, wherein the cross-block is mounted to the cabinet.

3. The oven appliance of claim 1, further comprising a sleeve positioned on a first one of the connecting members.

4. The oven appliance of claim 3, wherein the sleeve is constructed with a plastic.

5. The oven appliance of claim 1, further comprising a spacer block mounted to the cabinet and engaging a first one of the connecting members in order to urge the first one of the connecting members away from a second one of the connecting members.

6. The oven appliance of claim 5, wherein the spacer block is positioned proximate one of the pair of sprockets.

7. The oven appliance of claim 1, wherein each connecting member of the pair of connecting members extends between a first end portion and a second end portion, each connecting member of the pair of connecting members also defining a substantially flat face between about the first end portion of the connecting member and about the second end portion of the connecting member, the substantially flat faces of the connecting members facing each other at the location where the connecting members cross each other.

8. The oven appliance of claim 1, wherein a first one of the connecting members is constructed with a first material and a second one of the connecting members is constructed with a second material, the first material having a hardness that is less than a hardness of the second material.

9. The oven appliance of claim 1, wherein the cross-block is positioned above a gap defined between the doors of the pair of doors.

10. The oven appliance of claim 1, wherein the connecting members of the pair of connecting members and the chains of the pair of chains are connected together in a figure-eight shape.

11. The oven appliance of claim 1, wherein the cross-block is constructed with a plastic.

12. The oven appliance of claim 11, wherein the connecting members are constructed with a metal.

13. An oven appliance, comprising:

a cabinet defining a chamber for receipt of food items for cooking, the chamber being accessible through an opening defined by the cabinet;

a heating element for providing heat to food items within the chamber of the cabinet;

a pair of doors mounted proximate the opening, each door of the pair of doors having an axis of rotation about which the door is rotatable so as to open or close access to the chamber of the cabinet through the opening of the cabinet;

a pair of sprockets, each sprocket of the pair of sprockets connected with a respective door of the pair of doors and positioned along the axis of rotation of the door so as to rotate with the door;

a pair of chains, each chain of the pair of chains meshing with a respective sprocket of the pair of sprockets;

a pair of connecting members extending between and connecting the chains of the pair of chains such that rotational motion is transferred between the pair of doors; and a cross-block mounted to the cabinet and positioned between the connecting members at a location where the connecting members cross each other, the cross-block defining a first channel and a second channel, the first and second channels of the cross-block positioned on opposite sides of the cross-block relative to each other, a first one of the connecting members positioned within the first channel of the cross-block and a second one of the connecting members positioned within the second channel of the cross-block such that the cross-block is positioned between the first and second ones of the connecting members at the location where the connecting members cross each other.

14. The oven appliance of claim 13, wherein the cross-block is constructed with a plastic.

15. The oven appliance of claim 14, wherein the connecting members are constructed with a metal.

16. The oven appliance of claim 13, wherein the cross-block is positioned above a gap defined between the doors of the pair of doors.

17. The oven appliance of claim 13, wherein the connecting members of the pair of connecting members and the chains of the pair of chains are connected together in a figure-eight shape.

* * * * *